US007963854B2

(12) United States Patent
Nugent et al.

(10) Patent No.: US 7,963,854 B2
(45) Date of Patent: Jun. 21, 2011

(54) PORTABLE AUTOMATIC GOLF BALL DISPENSER

(75) Inventors: Ed Nugent, Dewitt, NY (US); David Hollis, Alexandria Bay, NY (US); Peter Beames, Encinitas, CA (US); Charles John Mansfield, Dustin Acres, CA (US)

(73) Assignee: Re-Pete-R Enterprises, LLC, Syracuse, NY (US)

( * ) Notice: Subject to any disclaimer, the term of this patent is extended or adjusted under 35 U.S.C. 154(b) by 76 days.

(21) Appl. No.: 12/398,440

(22) Filed: Mar. 5, 2009

(65) Prior Publication Data

US 2010/0224648 A1 Sep. 9, 2010

(51) Int. Cl.
*A63B 57/00* (2006.01)

(52) U.S. Cl. ..... 473/137; 294/19.2; 221/194

(58) Field of Classification Search ..... 473/386, 473/132–137; 294/19.2; 224/918, 919; 221/301, 221/194, 195

See application file for complete search history.

(56) References Cited

U.S. PATENT DOCUMENTS

| | | | | |
|---|---|---|---|---|
| 1,937,180 | A * | 11/1933 | Young | 473/137 |
| 1,940,321 | A * | 12/1933 | Pagett | 473/137 |
| 3,599,983 | A | 8/1971 | Melton | |
| 4,253,668 | A * | 3/1981 | Ose | 473/132 |
| 4,676,397 | A * | 6/1987 | Hoffmeister | 473/132 |
| 5,096,200 | A | 3/1992 | Komori et al. | |
| 5,599,237 | A | 2/1997 | Fetterman et al. | |
| 5,665,004 | A * | 9/1997 | Vlahovic | 473/137 |
| 5,674,130 | A | 10/1997 | Egan | |
| 6,174,243 | B1 | 1/2001 | Choi | |
| 6,199,926 | B1 * | 3/2001 | Lemoine | 294/19.2 |
| 6,328,659 | B1 * | 12/2001 | Peterson | 473/137 |
| 6,386,607 | B1 * | 5/2002 | Deininger | 294/19.2 |
| 6,419,589 | B1 * | 7/2002 | Carter | 473/134 |
| 6,585,603 | B2 * | 7/2003 | Montalvo | 473/136 |
| 6,685,575 | B1 | 2/2004 | Anderson | |
| 6,969,324 | B1 | 11/2005 | Staehs | |
| 7,166,034 | B2 | 1/2007 | Hines et al. | |
| 7,189,167 | B1 * | 3/2007 | Imahata | 473/282 |
| 2002/0151372 | A1 | 10/2002 | Montalvo | |
| 2005/0192109 | A1 | 9/2005 | Hines et al. | |
| 2007/0267454 | A1 * | 11/2007 | Baiz | 224/918 |
| 2010/0190563 | A1 * | 7/2010 | Smith | 473/137 |

FOREIGN PATENT DOCUMENTS

KR 20-0296809 12/2002

OTHER PUBLICATIONS

International Searching Authority, International Search Report and Written Opinion in PCT No. PCT/US2010/025996, Mailed Oct. 8, 2010.

* cited by examiner

*Primary Examiner* — Steven Wong
(74) *Attorney, Agent, or Firm* — Hiscock & Barclay, LLP

(57) ABSTRACT

A golf ball dispensing apparatus includes a tube configured to receive at least one golf ball, at least one leg configured to attach to said tube, means for releasing a golf ball from said tube, means for supplying power configured to engage said means for releasing a golf ball, an arm configured to receive a golf ball from said tube wherein said arm is configured to engage said tube at a hinge, and means for sensing motion configured to engage said means for releasing a golf ball.

10 Claims, 7 Drawing Sheets

PORTABLE AUTOMATIC GOLF BALL DISPENSER

TECHNICAL FIELD

The present invention relates to golf ball dispensers and more particularly, to portable automatic golf ball dispensers.

BACKGROUND INFORMATION

In order to improve their play, many golfers practice their strokes/shots/putts/swings (hereinafter "stroke(s)") at driving ranges, putting greens, or settings other than actual golf courses. In order to effectively practice and improve a golf stroke, the golfer benefits by maintaining as many variables constant as reasonably possible. Similarly, to effectively teach a golf stroke, both the teacher and the student benefit by maintaining as many variables constant as possible while having the ability to isolate and change as few variables as possible, including the specific variable(s) that the teacher determines would be beneficial for the student to improve. Examples of variables include the grip, arm position, and the stance, among many others. The practicing golfer is forced to focus on, and is unable to maintain constant, an increased number of variables when required to position a new ball by, for example, placing it on a tee or a putting green. In either case, the golfer likely must, for example, release his grip, alter his arm position, and/or adjust his stance. The problem is further exaggerated on the putting green where substantially exact positioning of a replacement ball cannot be accomplished unlike on the driving range where the golfer can maintain some variables constant by using a tee. The lack of a tee, when practicing putting, therefore, adds yet a further variable of ball location.

In consideration of the above issues, golf ball dispensing devices have been developed to assist a practicing golfer in repeatedly placing a golf ball by reducing the effort and movement required by the golfer thereby reducing the number of variables inherent in taking successive practice strokes. Golf ball dispensing devices known in the art generally consist of mechanical devices, operated primarily by gravity, and electromechanical devices having a power source.

One of the earliest mechanical and gravity-operated golf ball dispensers was disclosed by Melton in U.S. Pat. No. 3,599,983 in which a tube is configured to hold golf balls and a ramp connected to the tube is configured to serially receive golf balls upon engagement by the golfer with the ramp. A tooth structure connected to the ramp holds back the balls to allow only one ball to release and counterweights cause the ramp to return to the closed position subsequent to placing a ball. However, this device as well as many other mechanical devices including those disclosed more recently by Carter in U.S. Pat. No. 6,419,589 and by Hines et al. in U.S. Pat. No. 7,166,034, do not adequately solve the problem of reducing the number of variables because they require a pedal, actuator, or some other physical engagement with the device on the part of the golfer. Although many of these devices have very limited portability, U.S. Pat. No. 6,386,607 does disclose a substantially portable golf ball dispensing device but it too contains a lever arm that must be depressed in order to initiate the release of a golf ball. This physical engagement by either the golfer's foot or a club requires the golfer to move his stance, change his grip, and/or alter his arm position, and, in any event, inherently causes the number of variables present in successive practice strokes to increase.

To substantially improve on this limitation inherent in mechanical devices, electro-mechanical golf ball dispensing devices were developed in the art to reduce the number of variables relative to mechanical golf ball dispensing devices by generally automating the process of ball release and placement. However, many of these devices, such as that disclosed in U.S. Pat. No. 5,096,200 to Komori et al., for example, are not portable. Komori et al. teach the use of an infra-red sensor to activate a ball release mechanism but the machine is not configured to move. The device disclosed in U.S. Pat. No. 6,685,575 to Anderson, for example, although having an optical sensor and being technically portable because it has wheels, is not configured to be picked up and carried, such as by hand or attached to or disposed inside of a golf bag. Similarly, the device disclosed in U.S. Pat. No. 6,585,603 to Montalvo, although also disclosing the use of an optical sensor to sense whether a ball is on a tee, has reduced portability because of the substantially rectangular hopper. Also because of the hopper, a jogger mechanism is required to solve the problem of jamming, adding to the complexity and expense of the device. U.S. Pat. No. 5,674,130 to Egan discloses using a vibration sensor to activate a release mechanism but also has the problem of reduced portability due to the substantially rectangular storage container which has both an upper ball storage portion and a lower mechanism storage portion which together substantially reduce portability.

Although the device disclosed in U.S. Pat. No. 5,665,004 to Vlahovic is configured to be picked up, it requires significant effort including unscrewing a bolt and wing nut to remove the tube from a platform which further reduces portability because the golfer must then carry or store at least two components. The '004 disclosure also describes automating by configuring the foot pedal to activate a cylinder which causes the delivery tube to cycle as shown in FIG. 4. However, cycling is not very reliable because it does not account for variations in the time between strokes which may be significant in the situation of a golf lesson where the instructor wishes to impart some information or advice before the golfer continues his practice strokes. Although the apparatus disclosed in U.S. Pat. No. 6,969,324 to Staehs is also configured to be picked up and carried, activating the ball release mechanism requires the golfer to place the head of the golf club in close proximity to a photo sensor thus increasing the number of variables. Portability is also reduced in the apparatus disclosed by Staehs because a base and hinged tee platform are required. Another limitation of the '324 device, which is shared by the '004 device, is that it requires the presence of a tee attached to a base causing the golfer to manually remove a ball from the tee to practice a putting stroke, thus increasing the number of variables.

Accordingly, there is a need for an improved golf ball dispensing apparatus having increased portability, versatility, and reliability of automatic golf ball release and placement, while still being simple, easy to operate, and inexpensively manufactured.

BRIEF DESCRIPTION OF THE DRAWINGS

These and other features and advantages will be better understood by reading the following detailed description, taken together with the drawings wherein.

DETAILED DESCRIPTION

Figure 1:
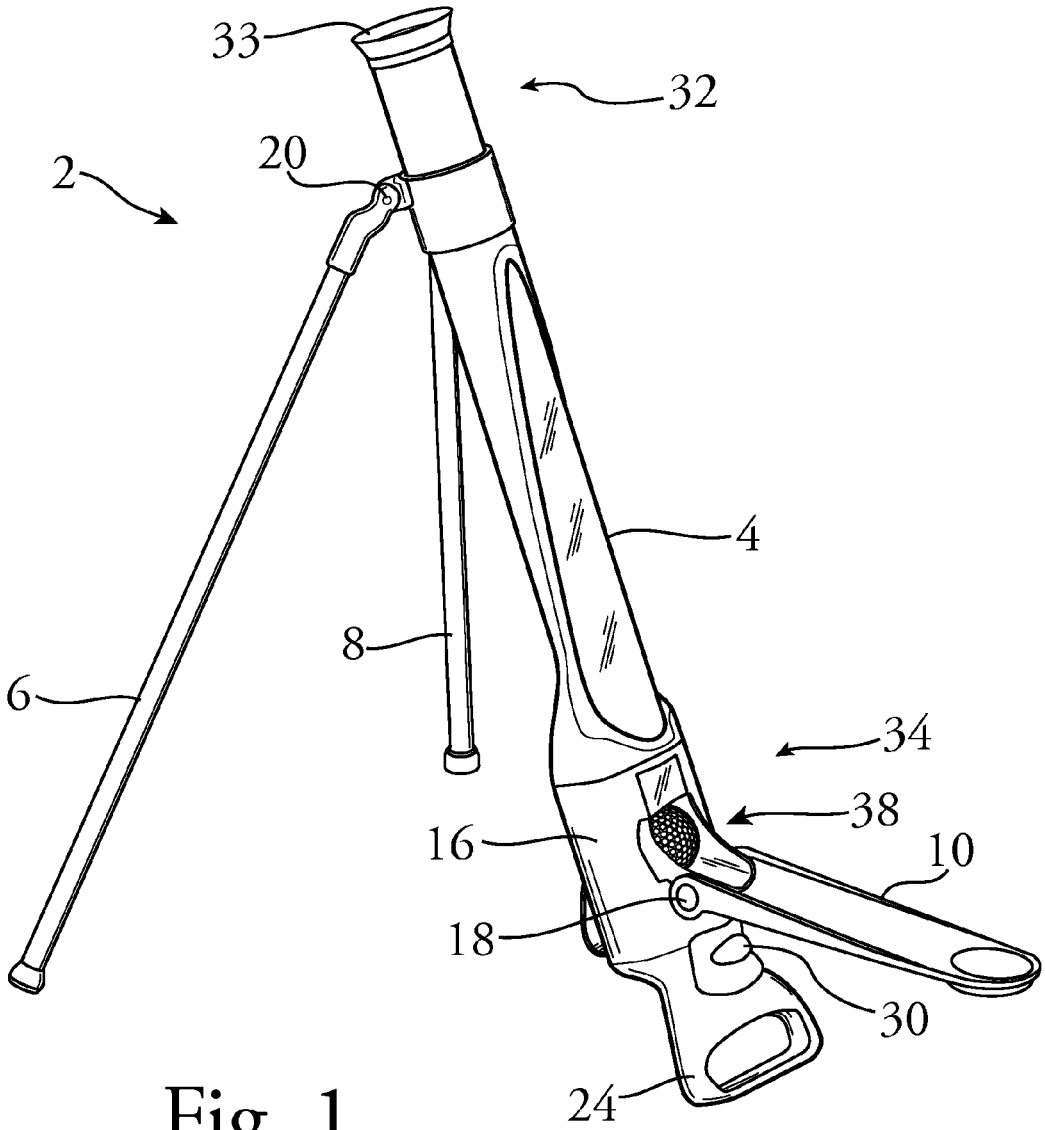
FIG. 1 is a perspective view of a portable automatic golf ball dispenser in a release position.
Figure 2:
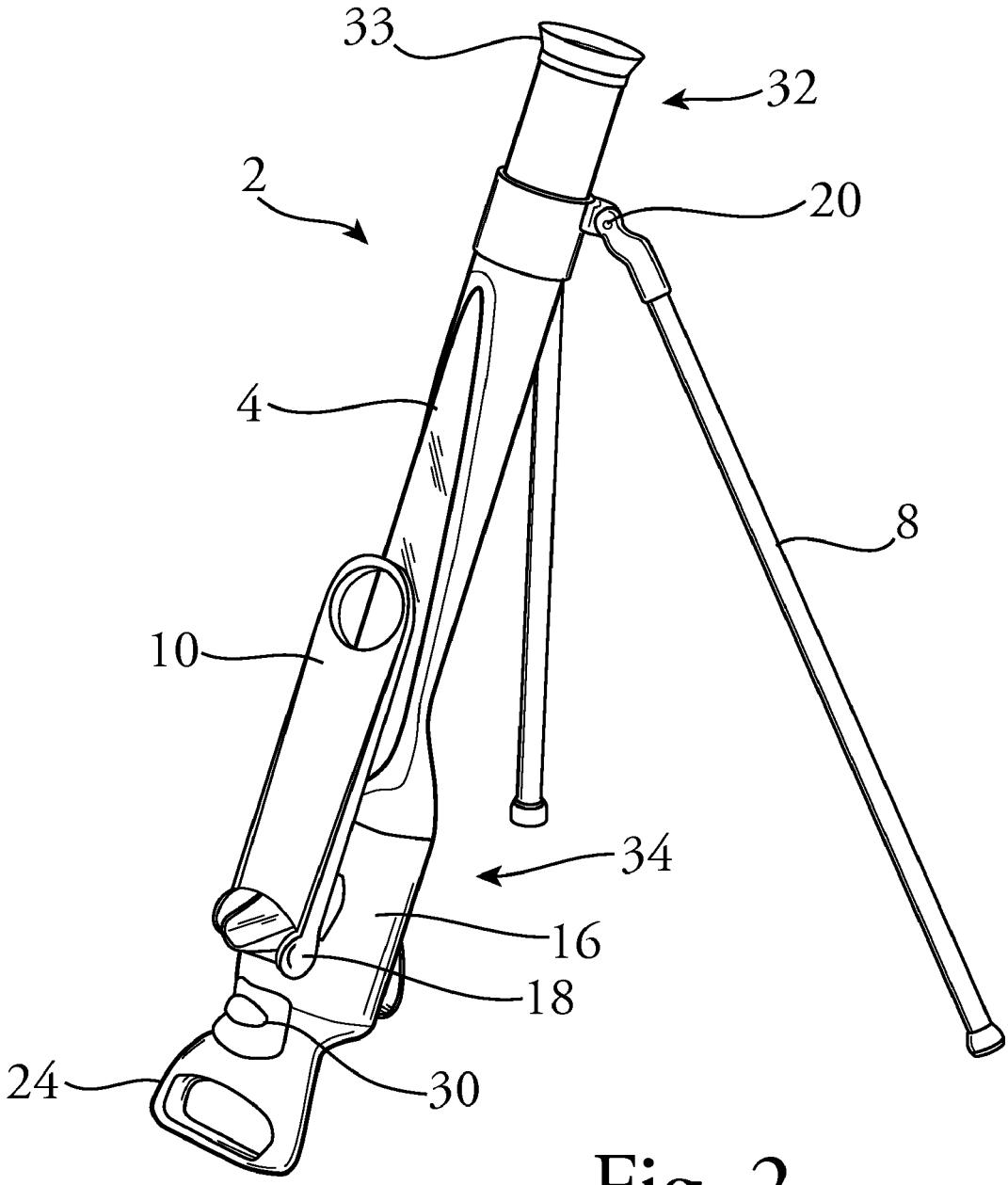
FIG. 2 is a perspective view of a portable automatic golf ball dispenser in a ready position.

Referring to FIG. 1, one embodiment of a portable automatic golf ball dispenser 2 is shown generally as including a tube 4, at least one leg 6, 8, an arm 10, a motor housing 16, and a sensor 30. Generally, at least one ball is inserted at or received by a receiving end 32 of the tube 4 and released by a dispensing end 34 of the tube 4 onto the arm 10. The arm 10 is configured to place a ball on a tee or a ground surface. When the ball has been hit by a golfer, a sensor 30 is configured to signal a motor which is disposed inside the motor housing 16. The motor is configured to engage a rocker mechanism which is also disposed inside the motor housing 16. The rocker mechanism then rotates such that a new ball is released, causing the arm 10 to lower into a release position as shown in FIG. 1. The new ball then rolls down the arm 10 and is released by the arm 10 and placed onto a tee or ground surface in substantially the same position as the previously hit ball. After the new ball is released by the arm 10, the arm 10 automatically raises to a ready position as shown in FIG. 2. Once the sensor 30 senses that the new ball has been hit, the sensor 30 engages the motor, as described further below, and the release process is repeated.

More specifically, a tube 4, as shown in FIG. 1, can be configured to receive a golf ball at a receiving end 32 and release a golf ball toward a dispensing end 34. Optionally, the tube 4 can be substantially non-opaque such that a golfer can see the number of golf balls remaining in the tube 4. Disposed at the receiving end 32 can be a removable cap configured to pull or screw off of the tube or, more preferably, the receiving end 32 can be a retrieval mechanism 33. The retrieval mechanism 33, as is well known in the art, can be configured both to accept a ball when positioned on top of the ball, and downward pressure is applied, and to hold the ball in the tube 4 once accepted. Generally, a ball can be inserted into the tube 4 by hand or by a retrieval mechanism 33. Disposed at the dispensing end 34 of the tube 4 can be a removable cap configured to pull or screw off of the tube 4 or, more preferably, a handle 24 to aid in the carrying of the apparatus 2. The handle 24 can also aid in the acceptance of a golf ball using the retrieval mechanism 33 by allowing for a convenient hand position when applying downward pressure. The handle 24 can also aid in pulling the apparatus 2 out of its attachment to a golf bag, in which it is capable of being conveniently stored due to its generally cylindrical shape, or on the outside of a golf bag according to the golfer's preference.

Disposed toward the dispensing end 34 of the tube 4 can be an opening 38 configured to allow passage of a golf ball. An arm 10 can be attached to the tube 4 by a hinge 18 which is disposed below the opening 38 in the tube 4 in FIGS. 1-2. Adjacent the hinge 18 can be a motor housing 16 attached to the tube 4 and configured to enclose, for example, a motor and a rocker mechanism attached to the motor as described further below.

Figure 3:
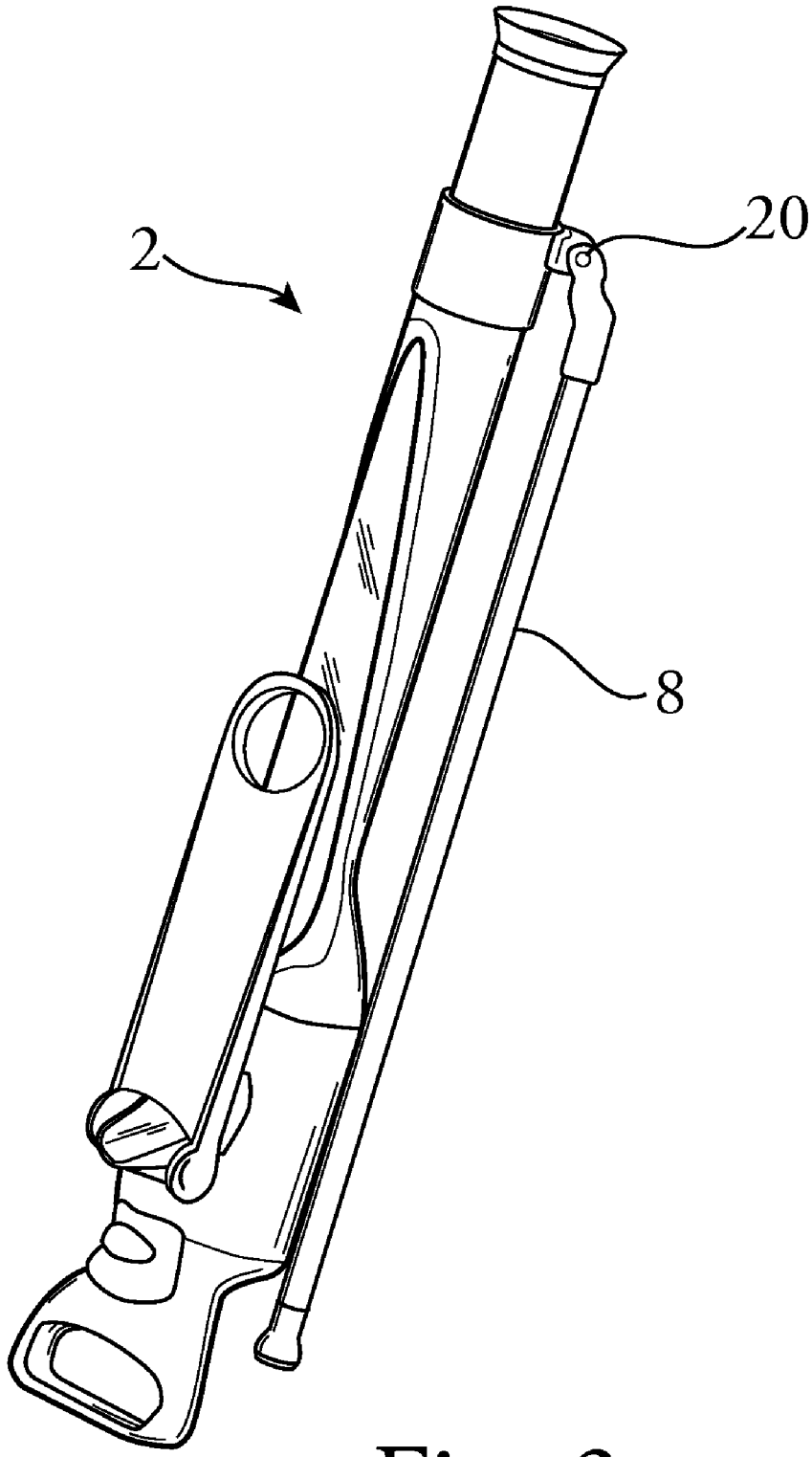
FIG. 3 is a perspective view of a portable automatic golf ball dispenser in a storage position.

A first leg 6 and a second leg 8 are also shown in FIG. 1 as being disposed toward the receiving end 32 of the tube 4. However, it should be appreciated that one leg, for example with a prong(s) or spike(s) at the end, can be sufficient to hold the apparatus 2 upright. It should also be appreciated that the leg(s) 6, 8 can be disposed anywhere along the tube 4. However, in the preferred embodiment two legs 6, 8 are preferably positioned towards the receiving end 32 of the tube 4 to allow for increased stability. Optionally, leg hinge(s) 20, as shown in FIGS. 1-3, can be attached to each of the leg(s) 6, 8. The hinge(s) 20 allow for the leg(s) 6, 8 to be folded as shown in FIG. 3, significantly increasing the portability of the apparatus 2.

Figure 4:
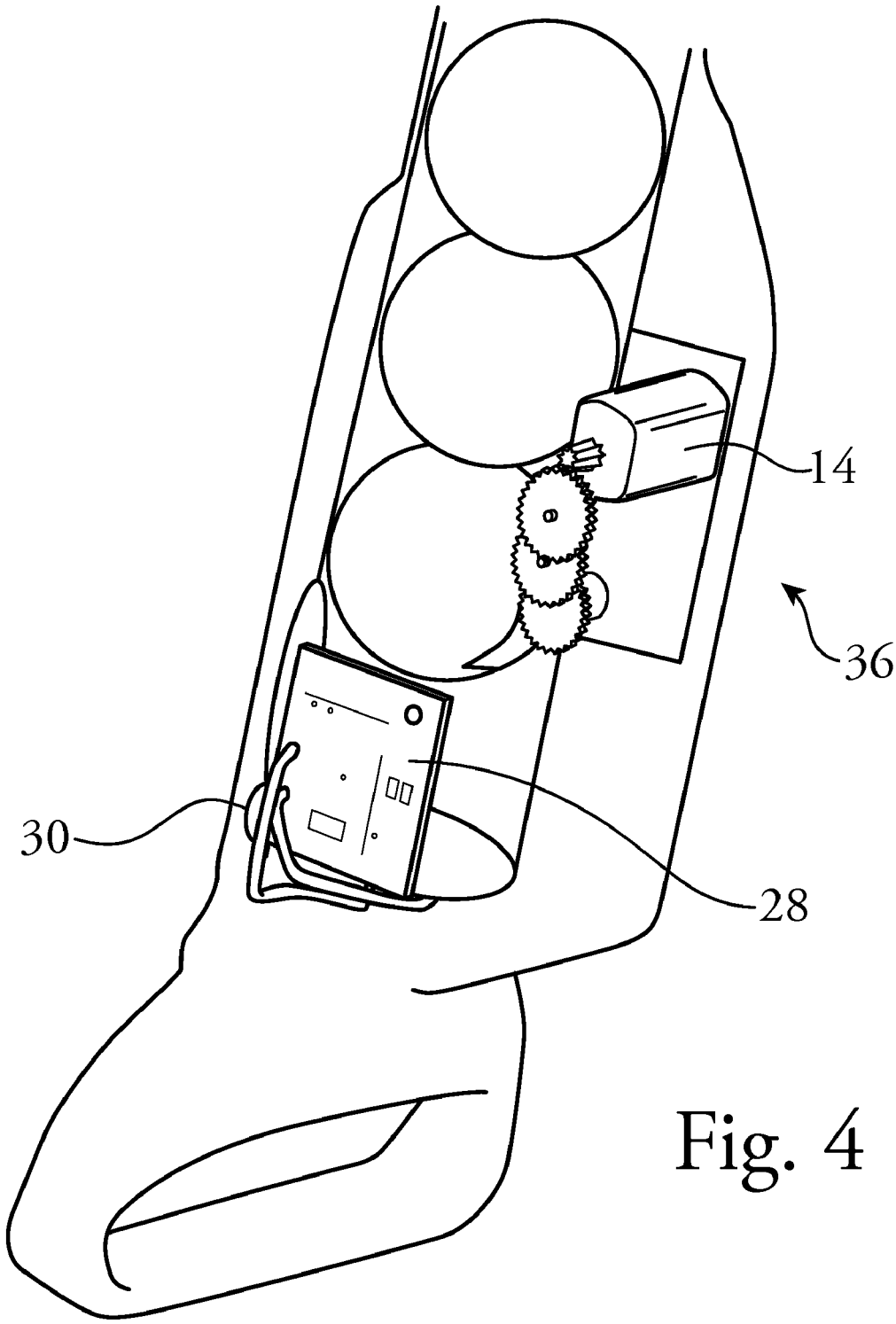
FIG. 4 is a view of a control mechanism, without a tube or housing, of a portable automatic golf ball dispenser.

FIG. 4 shows a view of the control mechanism 36 including a sensor 30 connected to a controller 28, optionally disposed on at least one circuit board. The sensor 30 can be an optical sensor, a photo-detector, an infrared sensor or any other sensor configured to detect when a golf ball has been hit and to signal the controller 28 that a new ball is needed. Upon receiving a signal from the sensor 30, the controller 28 can signal a motor 14 to engage a rocker mechanism 12 as shown in FIG. 5.

Figure 5:
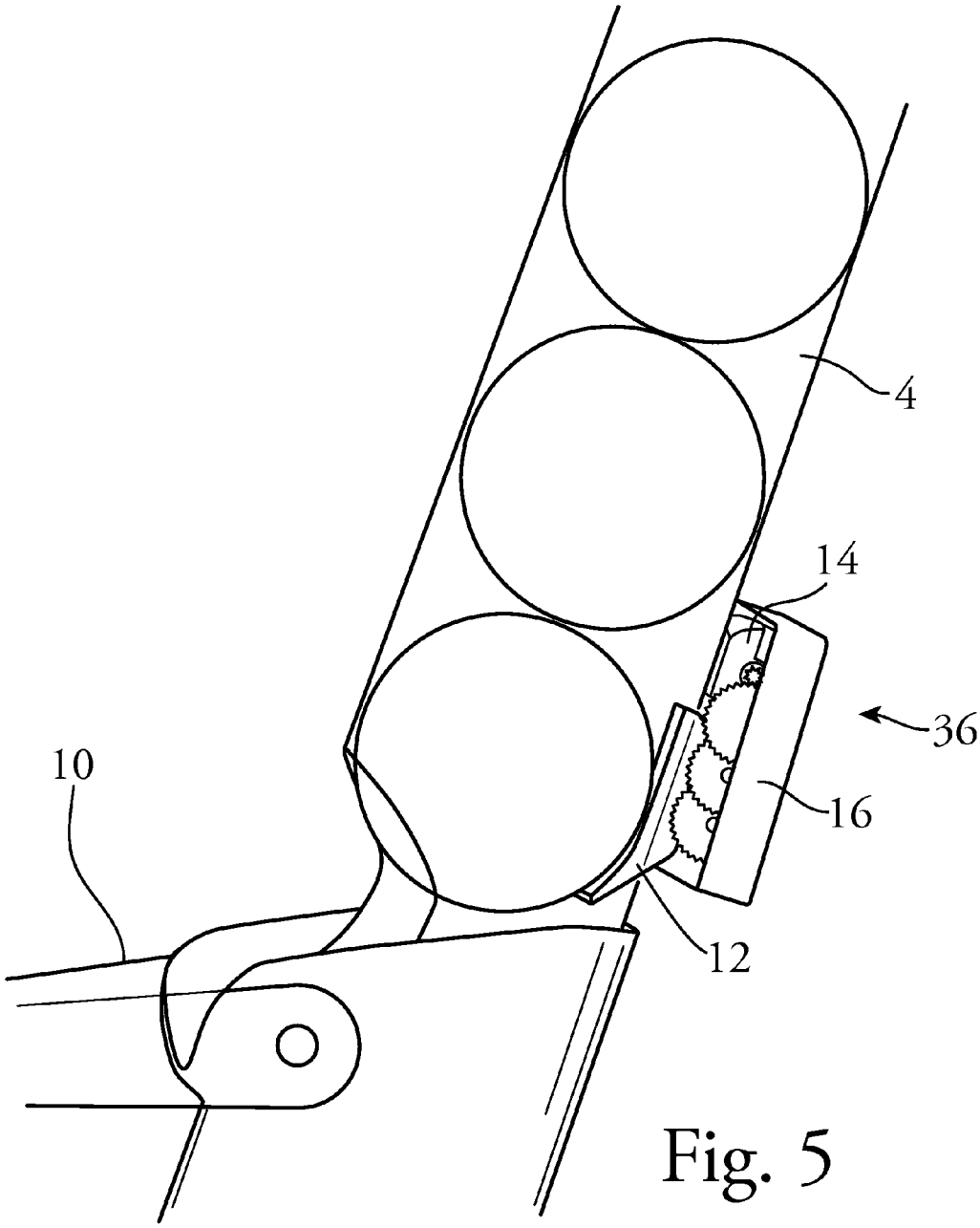
FIG. 5 is a close-up view of a control mechanism, having a housing, of a portable automatic golf ball dispenser.

FIG. 5. shows a close-up view of the control mechanism 36 along with the tube 4 and motor housing 16. The motor 14 and rocker mechanism 12 are shown optionally disposed substantially inside the motor housing 16. The tube 4 optionally has an opening configured to allow the rocker mechanism 12 to protrude into the tube 4 in order to engage a golf ball, release the golf ball from the tube 4, and transfer the golf ball to the arm 10. The rocker mechanism 12 can rotate such that a ball is released from the tube and transferred onto the arm 10. Upon transfer, the rocker mechanism 12 can rotate back in order to keep the remaining balls in the tube 4 thereby effectuating a release of only one ball at a time.

Once a golf ball is transferred to the arm 10, gravity will cause the ball to roll down the arm until it reaches a release point. The release point can be the arm 10 ending causing the ball to roll off of the arm 10, a plurality of prongs configured to aid in the placement of the ball, or an opening in the arm combined with a spout or chute disposed below the opening to allow for increased precision in ball placement, for example. However, the sprout or chute may add to the overall width of the apparatus 2 in the storage position thus reducing its portability and increasing its size and presence inside or outside of a golf bag, for example. Therefore, in the preferred embodiment, the release point can be a substantially circular opening on the arm configured to be slightly larger than the diameter of a golf ball as shown in FIGS. 1-3 which allows for substantially precise ball placement while reducing the overall size of the apparatus 2.

Figure 6:
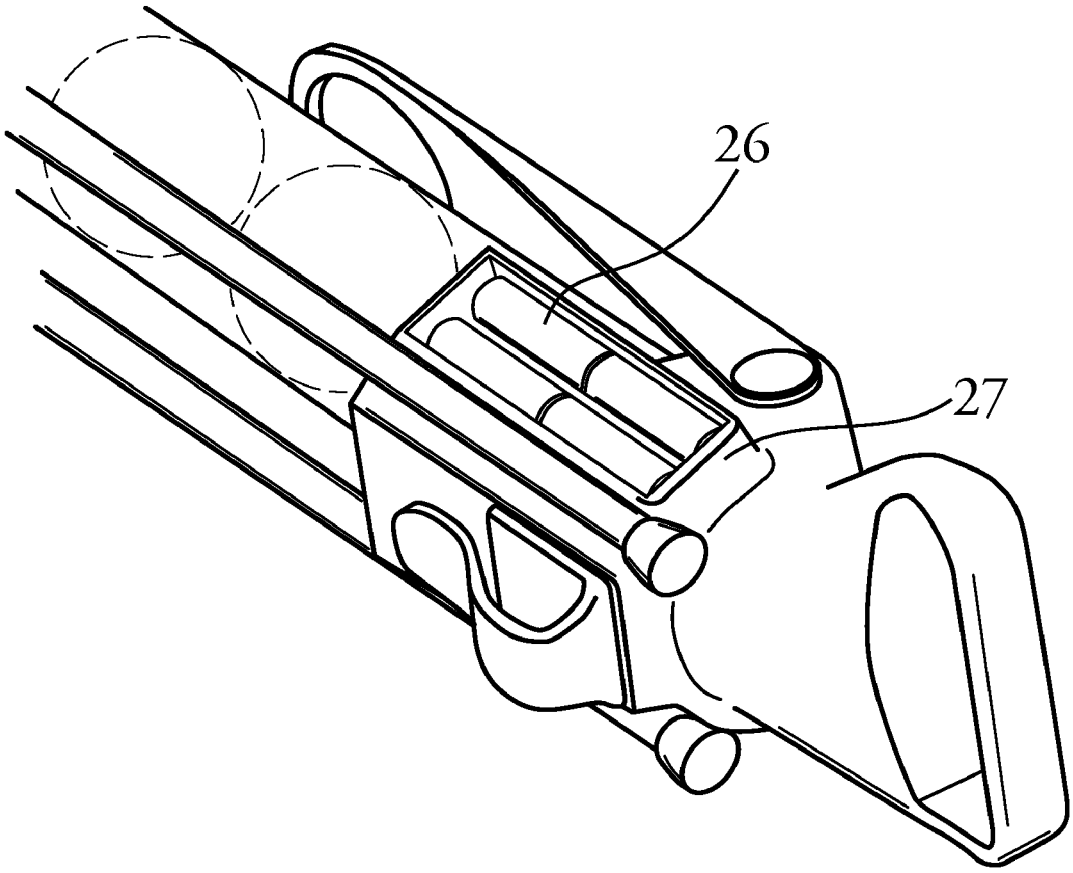
FIG. 6 is a close-up view of a power supply of a portable automatic golf ball dispenser.

Shown in FIG. 6 is a power supply 26 which can be a battery, photovoltaic panel, hand crank, or any other power source configured to engage the control mechanism 36 (FIGS. 4-5). FIG. 6 also shows the power supply 26 disposed adjacent the motor housing 16 (FIG. 5) and optionally disposed inside a power supply housing 27. The power supply 26 can also be disposed inside the motor housing 16 (FIG. 5), on the outside of the motor housing 16 (FIG. 5) or power supply housing 27, if present, such as in the case of a photovoltaic panel, or disposed on the outside of the tube 4, for example. The power supply can also include conventional means for plugging the apparatus into an AC power source.

Figure 7:
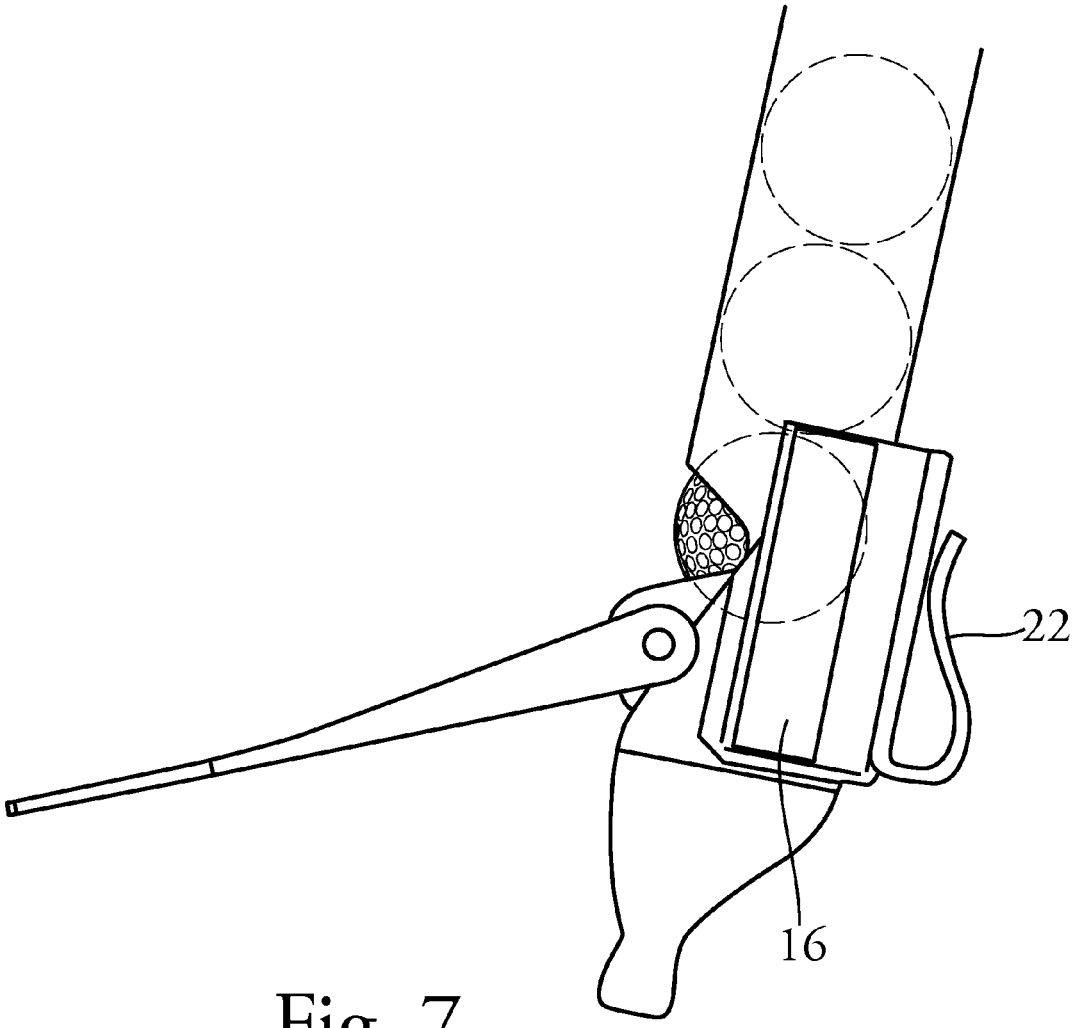
FIG. 7 is a close-up view of a portable automatic golf ball dispenser having an optional clip.

FIG. 7 shows an optional clip 22 disposed outside of the motor housing 16. The clip 22 can be used to attach the apparatus 2 to, for example, a golf bag so that the golfer need not carry the apparatus 2 separate from the golfer's clubs when transporting. The clip 22 can also be disposed outside the power supply housing 27, if present, or outside the tube 4. Also optionally disposed outside the motor housing 16, the power supply housing 27, if present, or anywhere along the outside of the tube 4 is a tee holder (not shown) configured to hold conventional golf tees for convenient access by a golfer when using the apparatus 2 to hit a golf ball from a tee.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A golf ball dispensing apparatus, comprising:

a tube including a receiving end and a dispensing end wherein the tube is configured to receive at least one golf ball toward the receiving end;

at least one leg configured to pivotably attach to said tube toward the receiving end;

an arm configured to receive a golf ball from said tube wherein said arm is configured to pivotably engage said tube toward the dispensing end;

a rocker mechanism configured to transfer a golf ball from the tube to the arm;

a power supply;

a motor configured to rotatably engage the rocker mechanism wherein the motor is in electrical communication with the power supply;

a sensor in electrical communication with the power supply; and a controller in electrical communication with the power supply, the sensor, and the motor.

2. The golf ball dispensing apparatus of claim 1 wherein said power supply is selected from the group consisting of at least one battery, at least one photovoltaic panel, a hand crank, and means for receiving an alternating current.

3. The golf ball dispensing apparatus of claim 1 also comprising a second leg configured to pivotably attach to the tube toward the receiving end.

4. The golf ball dispensing apparatus of claim 1 including a handle configured to be disposed at said dispensing end of said tube.

5. The golf ball dispensing apparatus of claim 1 further including a golf ball retrieving mechanism configured to be disposed at said receiving end of said tube.

6. The golf ball dispensing apparatus of claim 1 wherein at least a portion of said tube is substantially non-opaque.

7. The golf ball dispensing apparatus of claim 1 wherein said arm includes means for releasing a golf ball.

8. The golf ball dispensing apparatus of claim 7 wherein said means for releasing a golf ball include a substantially circular opening.

9. The golf ball dispensing apparatus of claim 1 wherein said sensor is selected from the group consisting of an optical sensor, a photo-detector, and an infrared sensor.

10. The golf ball dispensing apparatus of claim 1 including a clip configured to be attached to said apparatus wherein said clip is configured to engage a golf bag.

* * * * *